US005788303A

United States Patent [19]

Chia-Hsiang

[11] Patent Number: 5,788,303

[45] Date of Patent: Aug. 4, 1998

[54] PORTABLE WRENCH RACK

[76] Inventor: Chen Chia-Hsiang, Suite 2, 7F, No. 95-8, Chang Ping Road, Sec. 1, Taichung, Taiwan

[21] Appl. No.: 679,816

[22] Filed: Jul. 15, 1996

[51] Int. Cl.[6] ..... A45F 5/00

[52] U.S. Cl. ..... 294/143; 294/159; 211/70.6; 206/376; 206/504; 220/331

[58] Field of Search ..... 294/141–143, 294/145, 146, 159–163; 211/70.6, 70.7; 206/349, 372–378, 504; 220/329, 331

[56] References Cited

U.S. PATENT DOCUMENTS 3,851,936 12/1974 Muller ..... 206/504
4,667,822 5/1987 Coopmans ..... 294/146
4,819,800 4/1989 Wilson ..... 206/373
4,852,930 8/1989 Agee ..... 294/143
5,366,073 11/1994 Turrentine et al. ..... 206/504

*Primary Examiner*—Dean Kramer

[57] ABSTRACT

A portable wrench rack is provided. The rack includes a rectangular housing, a handle projected upward from the top of the housing, a pair of dovetail grooves and a pair of dovetail protrusions superposedly formed on respective lateral walls of the housing and a suspension member on the bottom of the housing having a plurality of L-shaped slots vertically formed in the front portion thereof for suspending the wrenches therefrom. A slidable front door slidably engages into a pair of guide slots in the housing and closes the front side of the housing in a snap fitting. Thereby, the wrench rack of the present invention is portable, suspensible and juxtaposedly combinative.

6 Claims, 4 Drawing Sheets

PORTABLE WRENCH RACK

BACKGROUND OF THE INVENTION

The present invention relates to racks, and more particularly to a wrench rack which has an improved structure to be readily portable, suspensible and juxtaposedly combinative.

Currently, wrenches are used to place into a tool box or a tool outfit or displayed in a tool rack. Sometimes, pads are provided in the tool box. Each pad has a plurality of grooves made in conformation with the shaped of the wrenches in order to receive different size of the wrenches therein. This arrangement is inconvenient to pick up a desired wrench from the tool box. In retailer's shop, the wrench is separately packed in a plastic package. This provides a great convenience to sell the wrench on one by one basis. But the packages always cause environmental problems.

SUMMARY OF THE PRESENT INVENTION

The present invention has a main object to provide a portable wrench rack which has a plurality of position slots for regular placing wrenches of different sizes therein.

Another object of the present invention is to provide a portable wrench rack which is suspensible and juxtaposedly combinative.

Still another object of the present invention is to provide a portable wrench rack which saves labor and material to pack at retail.

The present invention will become more fully understood by reference to the following detailed description thereof when read in conjunction with the attached drawings.

DETAILED DESCRIPTION OF THE PREFERRED EMBODIMENT

Figure 1:
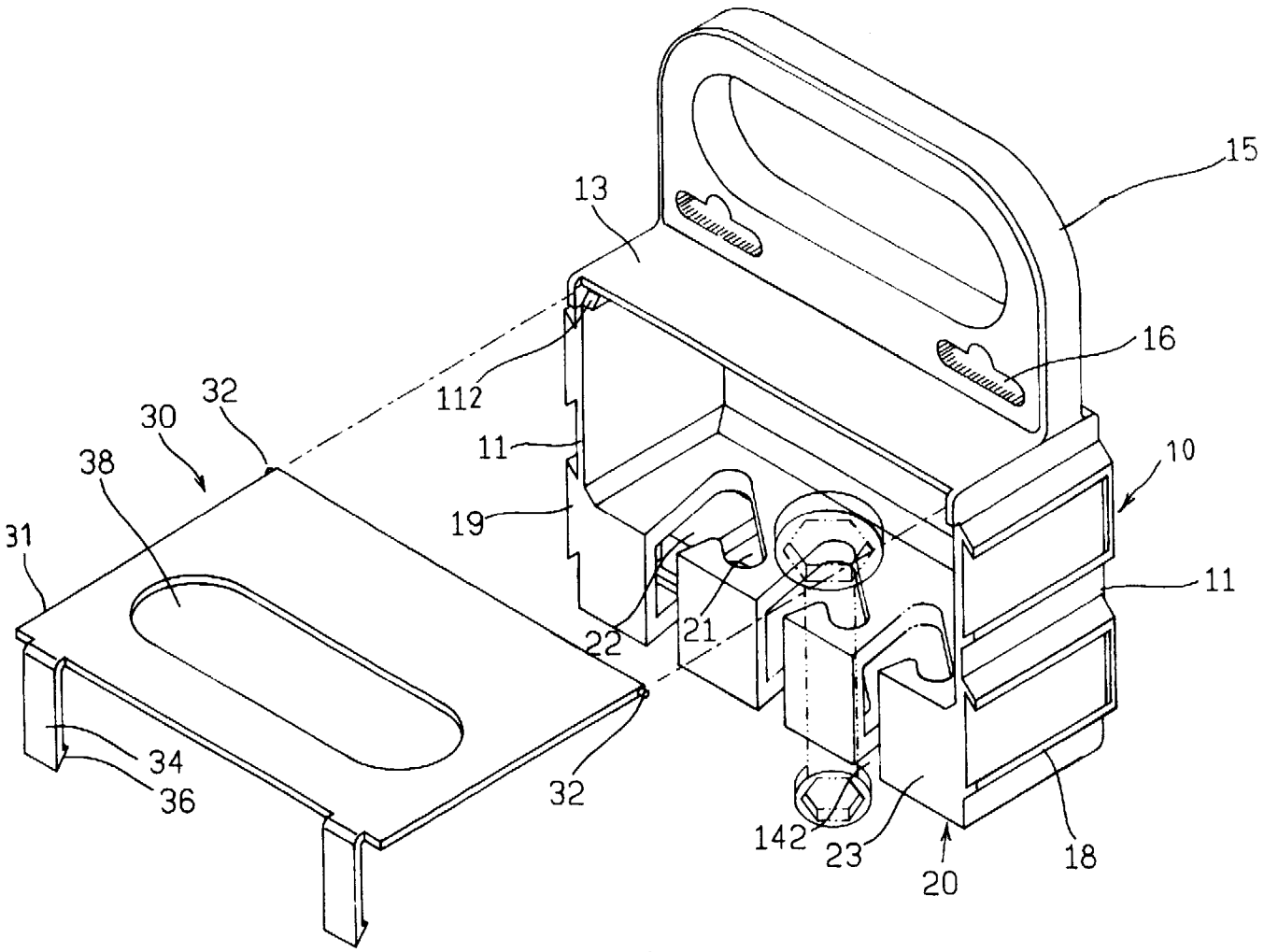
FIG. 1 is an exploded perspective view to show a preferred embodiment of the present invention.
Figure 2:
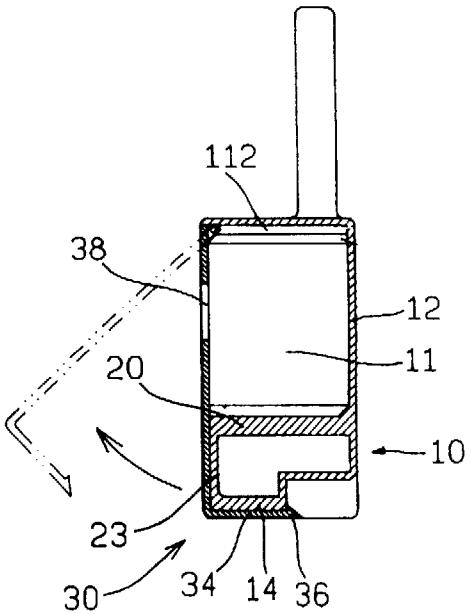
FIG. 2 is a sectional view looking from a lateral side to show an assembled wrench rack of FIG. 1.
Figure 3:
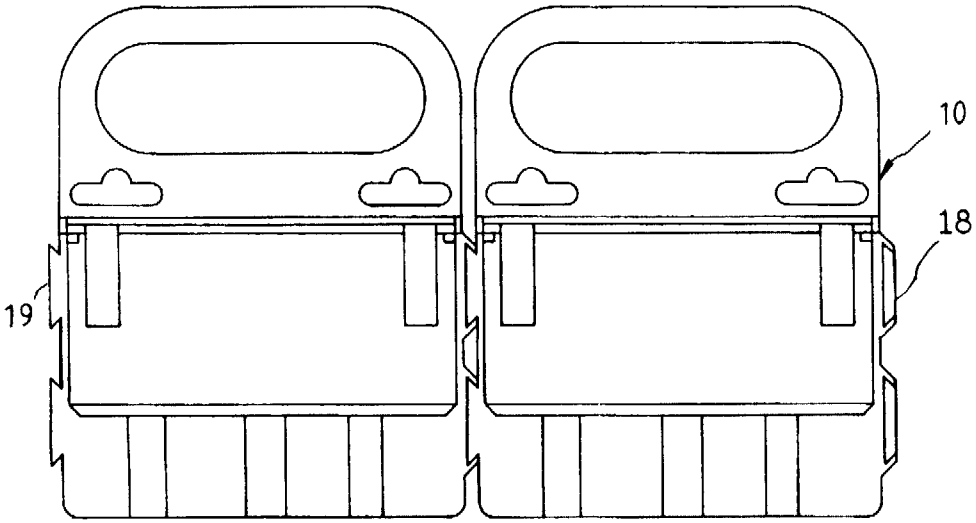
FIG. 3 is a front view to show a combination of the wrench racks according to the present invention.

With reference to FIGS. 1 and 2 of the drawings, the portable wrench rack of the present invention comprises a rectangular housing 10, a suspension member 20 and a slidable front door 30. The housing 10 is made integral with a pair of lateral walls 11, a back wall 12, an upper wall 13 and the suspension member 20 which is integrated on the lower portion thereof. A handle 15 projects upward from the top of the upper wall 13 including a pair of hanging apertures 16 symmetrically formed adjacent the lower end thereof. A pair of dovetail slots 18 superposedly formed on the outward surface of the right side lateral wall and a pair of dovetail protrusions 19 superposedly projected from the outward surface of the left side lateral wall made in registry with the dovetail slots 18, so that the dovetail protrusions 19 of a second wrench rack can be engaged into the dovetail slots 18 of a first wrench rack, vice versa (as shown in FIG. 3). The suspension member 20 has a hollow interior for lessening the weight of the wrench rack and a plurality of roughly L-shaped suspending slots 21 vertically formed spaced apart in the front side. Each of the slots 21 has a longer portion 22 for the entrance of a wrench and a shorter portion 21 for the engagement of the wrench therein as indicated in FIG. 1. The housing 10 further has a pair of guide slots 112 respectively formed on the inward surface of the lateral walls 11 on the upper portion beneath the distals of the upper wall 13.

The slidable front door 30 comprises a flat rectangular body 31, a pair of axle rods 32 respectively projected from two ends of the body 31 adjacent the upper edge thereof for slidably engaging into the guide slots 112, a pair of elastic first locking means 34 symmetrically formed spaced apart on the lower edge of the body 31 each having a introversion hook 36 at free end and a window 38 centrally formed in the lower portion of the body 31. When the axle rods 32 engage into the guide slots 112, the front door 30 can be slid into the slots 112 so as to stop there at an opening position or to rotate downward to permit the hook 36 of the locking means 34 thereof snap engaging with a retaining edge of the under side 14 of the housing 10 as shown in FIG. 2. This arrangement is advantageous to facilitate a readily opening of the door 30 when the wrench rack is displayed on a wall and a readily closing of the door 30 when the rack is carried by an user. Besides, the window 38 provides that the wrenches inside can be visited from outside of the housing 10.

Figure 4:
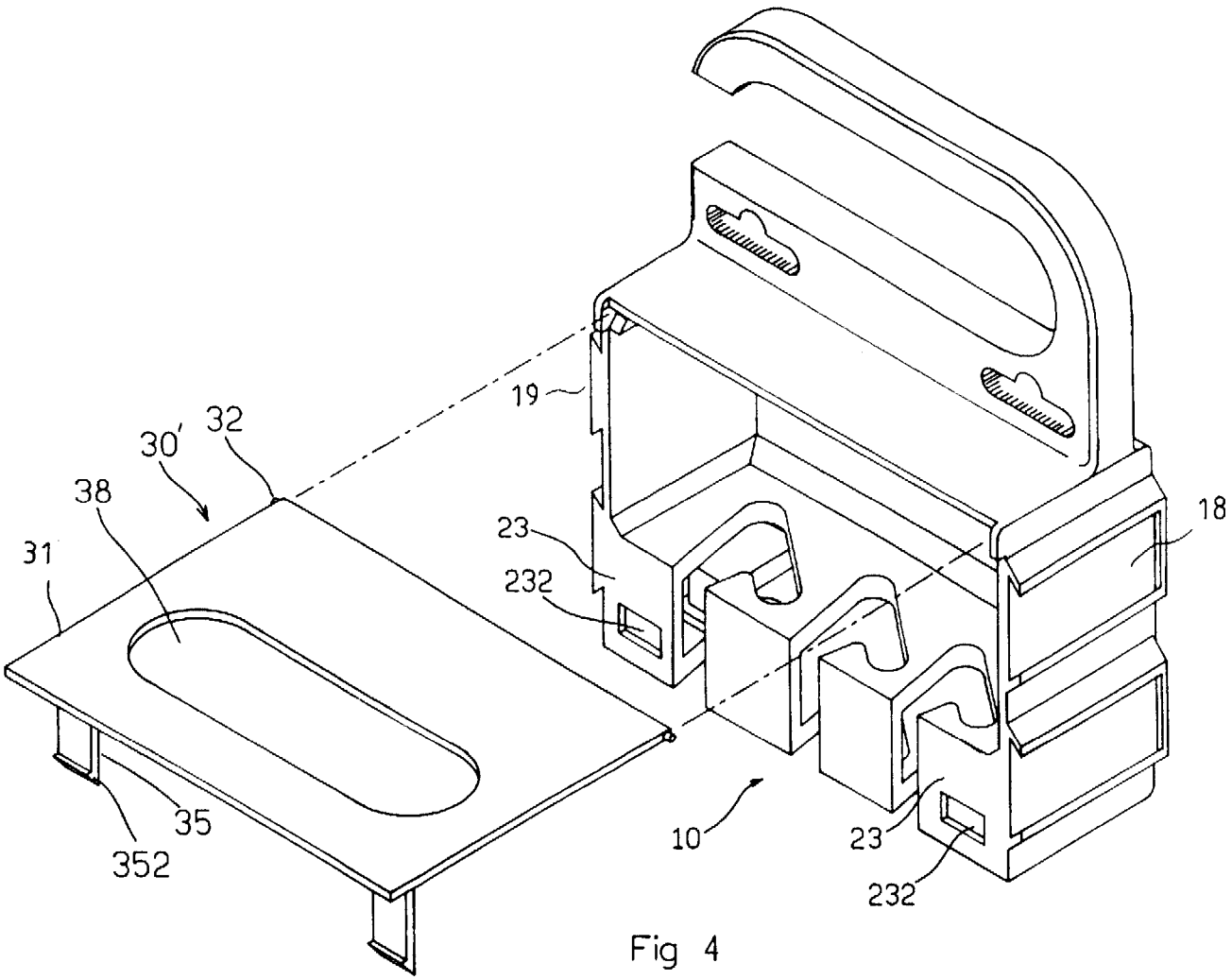
FIG. 4 is an exploded perspective view to show an alternative embodiment of the present invention.

Referring to FIG. 4, an alternative embodiment of a slidable front door 30' is shown, in which the general function and the structure are mostly similar to the front door 30 illustrated in FIG. 1 and the above discussion is equally applicable in the most instances. The only difference is that the pair of the first locking means 34 is now replaced with a pair of second locking means 35 which are spacedly projected inward from the inner surface of the body 31 adjacent the lower edge thereof, each having an outward hook 352 at free end. In registry with the alternative locking means 35, a pair of rectangular locking recesses 232 are spacedly formed in lower front wall 23 of the suspension member 20. So that when the front door 30' is closed, the pair of the second locking means 35 are engaged into the recesses 232 in a snap fitting.

Figure 6:
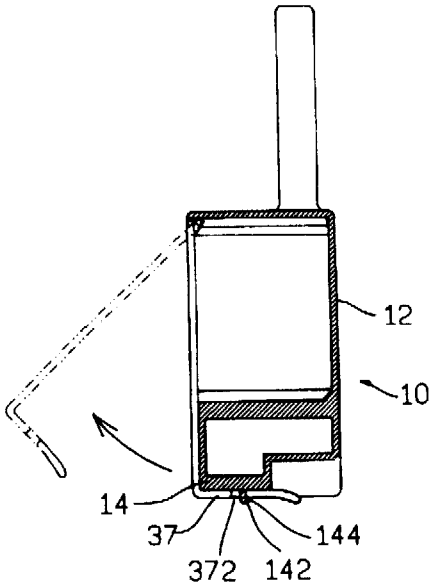
FIG. 6 is a sectional view to show an assembled wrench rack of FIG. 5.
Figure 5:
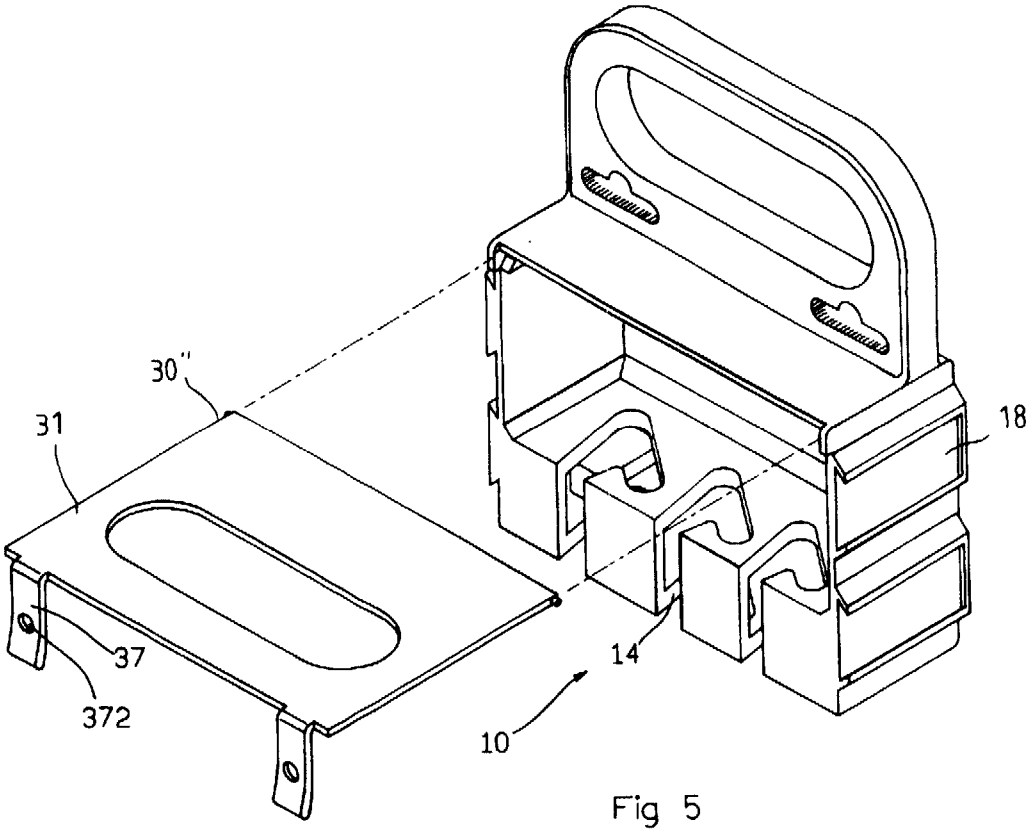
FIG. 5 is an exploded perspective view to show another alternative embodiment of the present invention.

Referring to FIGS. 5 and 6, another alternative embodiment of a slidable front door 30" is shown, in which the general structure and function remain unchanged as recited in the above embodiments. The only difference is that the first and second locking means 34 and 35 are replaced with a pair of third elastic locking means 37 which perpendicularly extend inward from the lower edge of the body 31 and each has a locking aperture 372 formed in an appropriate center thereof. In cooperation with, a pair of locking rods 142 are spacedly formed on the bottom of the housing 10 and each has a hook 144 at free end thereof. When the front door 30" is closed, the locking apertures 372 of the third locking means 37 engage with the locking rods 142 in a snap fitting, either.

Except the suspension of the wrenches, the wrench rack of the present invention also can receive other tools such as a screw driver or a hammer which has a larger end suspensible from the suspension member.

Note that the specification relating to the above embodiments should be construed as exemplary rather than as limitative of the present invention, with many variations and modifications being readily attainable by a person of average skill in the art without departing from the spirit or scope thereof as defined by the appended claims and their legal equivalents.

I claim:

1. A portable wrench rack comprising:

a housing having an upper wall, a back wall, a pair of first and second lateral walls and a suspension member integrally formed on lower portion thereof;

a handle means projected upward from a top of said upper wall having at least a hanging aperture formed in lower portion thereof;

a pair of guide slots respectively formed on an inward surface of said lateral walls and beneath distal portions of said upper wall;

a pair of dovetail grooves superposedly formed on the outer surface of said first lateral wall;

a pair of dovetail protrusions superposedly formed on the outer surface of said second lateral wall and made in registry with said dovetail grooves;

a slidable front door slidably engaged into said pair of guide slots, said door comprising a flat rectangular body, a window centrally formed in said body, a pair of axle rods respectively projected from lateral edges adjacent an upper edge and made in registry with said guide slots, and a pair of locking means perpendicularly extended spaced apart from a lower edge of said body each having an introversion hook at free end thereof;

whereby said wrench rack is portable, suspensible and juxtaposedly combinative.

2. A wrench rack as recited in claim 1, wherein said suspension member comprises a hollow interior and a plurality of L-shaped slots vertically formed in a front portion thereof, said slots each including an opening for entrance of a wrench and a transverse portion for suspending said wrench therefrom.

3. A wrench rack as recited in claim 1, wherein said pair of locking means each has an outward hook at free end thereof.

4. A wrench rack as recited in claim 3, wherein said suspension member further comprises a pair of locking recesses spacedly formed in a front wall and made in registry with said outward hook.

5. A wrench rack as recited in claim 1, wherein said pair of locking means each has a locking aperture centrally formed in a flat portion thereof.

6. A wrench rack as recited in claim 5, wherein said suspension member further comprises a pair of locking rods spacedly projected downward from an under side thereof and made in registry with said locking apertures and each having an introversion hook at free end thereof.

* * * * *